US007690117B2

(12) United States Patent
Rogatschnig

(10) Patent No.: US 7,690,117 B2
(45) Date of Patent: Apr. 6, 2010

(54) SHAVING APPARATUS WITH A SHORT-HAIR CUTTING DEVICE AND A LONG-HAIR CUTTING DEVICE

(75) Inventor: Johann Thomas Rogatschnig, Velden (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 33 days.

(21) Appl. No.: 10/569,175

(22) PCT Filed: Aug. 24, 2004

(86) PCT No.: PCT/IB2004/051547

§ 371 (c)(1),
(2), (4) Date: Feb. 22, 2006

(87) PCT Pub. No.: WO2005/021223

PCT Pub. Date: Mar. 10, 2005

(65) Prior Publication Data

US 2006/0288581 A1 Dec. 28, 2006

(30) Foreign Application Priority Data

Aug. 27, 2003 (EP) ..... 03103235

(51) Int. Cl.
*B26B 19/10* (2006.01)

(52) U.S. Cl. ..... 30/43.2; 30/43.6; 30/43.92

(58) Field of Classification Search ..... 30/34.1, 30/43.19, 43.4–43.46, 43.92, 346.51
See application file for complete search history.

(56) References Cited

U.S. PATENT DOCUMENTS

| | | | | | |
|---|---|---|---|---|---|
| 3,589,005 | A * | 6/1971 | Fischer et al | ..... | 30/34.1 |
| 3,855,697 | A * | 12/1974 | Meyer et al. | ..... | 30/34.1 |
| 3,950,847 | A * | 4/1976 | Duda | ..... | 30/34.1 |
| 3,967,372 | A * | 7/1976 | Beck et al. | ..... | 30/34.1 |
| 4,274,199 | A * | 6/1981 | Gallanis et al. | ..... | 30/34.1 |
| 4,393,585 | A | 7/1983 | Nagelkerke | | |
| 4,866,843 | A * | 9/1989 | Kumano | ..... | 30/34.1 |
| 4,922,608 | A * | 5/1990 | Pahl | ..... | 30/43.91 |
| 5,704,126 | A * | 1/1998 | Franke et al. | ..... | 30/34.1 |
| 5,943,777 | A * | 8/1999 | Hosokawa et al. | ..... | 30/34.2 |
| 6,317,982 | B1 * | 11/2001 | Andrew | ..... | 30/34.1 |
| 6,568,083 | B1 * | 5/2003 | Taniguchi et al. | ..... | 30/43.2 |
| 6,678,957 | B2 * | 1/2004 | Floessholzer | ..... | 30/34.2 |
| 2002/0138988 | A1 * | 10/2002 | Floessholzer | ..... | 30/34.2 |

FOREIGN PATENT DOCUMENTS

JP 01022279 A * 1/1989

* cited by examiner

*Primary Examiner*—Maurina Rachuba

(57) ABSTRACT

In a shaving apparatus (1) with a housing (2) and with a short-hair cutting device (30) projecting out of housing (2) and with a long-hair cutting device (36, 37) projecting out of housing (2), a common carrying device (45) is provided for the cutting devices (30, 36, 37), wherein the carrying device (45) is adjustable for height relative to the housing (2), so that all the cutting devices (30, 36, 37) can be adjusted for height together, and wherein there is a drive connection to a motor (16) of the shaving apparatus (1) in each operating position of the cutting devices (30, 36, 37) and consequently all the cutting devices (30, 36, 37) are drivable in each operating position of the cutting devices (30, 36, 37).

6 Claims, 3 Drawing Sheets

SHAVING APPARATUS WITH A SHORT-HAIR CUTTING DEVICE AND A LONG-HAIR CUTTING DEVICE

The invention relates to a shaving apparatus with a housing, said housing having a passage bounded by a housing edge and said housing containing a motor and a driving means drivable by the motor, and with at least one short-hair cutting device projecting out of the housing through the passage and comprising a short-hair cutting tool drivable by means of the motor and the driving means, and with at least one long-hair cutting device projecting out of the housing through the passage and comprising a long-hair cutting tool drivable by means of the motor and the driving means.

A shaving apparatus according to the design presented in the first paragraph above is known for example from patent document U.S. Pat. No. 6,317,982B1. In the known shaving apparatus, two adjacent short-hair cutting devices and two long-hair cutting devices are provided, the two short-hair cutting devices being arranged between the two long-hair cutting devices. In the known shaving apparatus, the two long-hair cutting devices are guided with possibility of adjustment parallel to an adjustment direction, so that each of the two long-hair cutting devices can be adjusted for height between different operating positions, which can also be called height positions. In the known shaving apparatus, at least one of the two long-hair cutting devices can be adjusted between a total of three height positions. By adjusting the long-hair cutting devices for height, different cutting characteristics of the long-hair cutting devices can be achieved, namely because in the case when the two long-hair cutting devices are closer to the housing of the known shaving apparatus, smoother cutting characteristics of the two long-hair cutting devices are achieved, though it has to be borne in mind that the hair trapping behavior of the two long-hair cutting devices is not as good. If the two long-hair cutting devices are adjusted to a height position that is farther away from the housing of the known shaving apparatus, this fact has the advantageous consequence of ensuring better hair trapping behavior and a shorter shaving time, but it has to be borne in mind that the long-hair cutting devices have less-gentle cutting characteristics.

In the known shaving apparatus there is the problem that adjustment of the two long-hair cutting devices produces a change in the relative positions between the two long-hair cutting devices and the two short-hair cutting devices, with the unfortunate result that adjustment of the two long-hair cutting devices causes differences in the cutting characteristics of the two short-hair cutting devices, which is particularly unfavorable when the two long-hair cutting devices are adjusted to their height position that is farthest away from the housing of the known shaving apparatus, because then the cutting characteristics of the two short-hair cutting devices are much less favorable.

The problem to be solved by the invention was to rectify the difficulties described above and create an improved shaving apparatus.

To solve the problem described above, in a shaving apparatus according to the invention, features according to the invention are provided, so that a shaving apparatus according to the invention can be characterized as follows:

Shaving apparatus with a housing, said housing having a passage bounded by a housing edge and said housing containing a motor and a driving means drivable by the motor, and with at least one short-hair cutting device projecting out of the housing through the passage and comprising a short-hair cutting tool drivable by the motor and the driving means, and with at least one long-hair cutting device that projects out of the housing through the passage and comprising a long-hair cutting tool drivable by the motor and the driving means, and with a carrying device which carries both the short-hair cutting device and the long-hair cutting device and is provided for combined adjustment of the short-hair cutting device and of the long-hair Cutting device and being movable parallel to an adjustment direction between a first operating position and a second operating position such that both the short-hair cutting device and the long-hair cutting device, with the Carrying device located in its second operating position, project farther from the housing than when the carrying device is in its first operating position wherein both with the carrying device located in its first operating position and with the carrying device located in its second operating position, both the drivable short-hair cutting tool of the short-hair cutting device and the drivable long-hair cutting tool of the long-hair cutting device are drivable by the motor and the driving means.

Provision of the features according to the invention has the effect that both the long-hair cutting device and the short-hair cutting device of a shaving apparatus according to the invention can be adjusted jointly between at least two operating positions, and thus between at least two height positions in relation to the housing of the shaving apparatus, in a simple and space-saving manner and at low cost. As a result, the cutting characteristics of the long-hair cutting device can be altered by adjusting it for height, which alters the distance of the long-hair cutting device from the housing, yet as a result of the combined height-wise adjustment of the tong-hair cutting device and of the short-hair cutting device, the cutting characteristics of the short-hair cutting device are not adversely affected, but remain as good as before, so that the cutting characteristics required by a person who is using a shaving apparatus according to the invention are provided in all operating positions of the long-hair cutting device and of the short-hair cutting device.

With a shaving apparatus according to the invention it has proved very advantageous if in addition the features according to claim 2 are provided. With said design, wherein the combination of the long-hair cutting configuration and of the short-hair cutting device is already known, a simple, space-saving solution is obtained by the design of the carrying device according to the invention.

With a shaving apparatus according to the invention it has also proved advantageous if in addition the features according to claim 3 are provided. Such a solution is advantageous with regard to simplest possible, comfortable handling and with respect to simplest possible design and construction.

These and other aspects of the invention are apparent from and will be elucidated with reference to the embodiment described hereinafter.

The invention is described in more detail below with reference to an embodiment illustrated in the drawings, but the invention is not limited to this.

FIGS. 1 to 3 show a shaving apparatus 1, which is mainly intended for use by female persons and for this reason is often called a "Ladyshaver".

Figure 1:
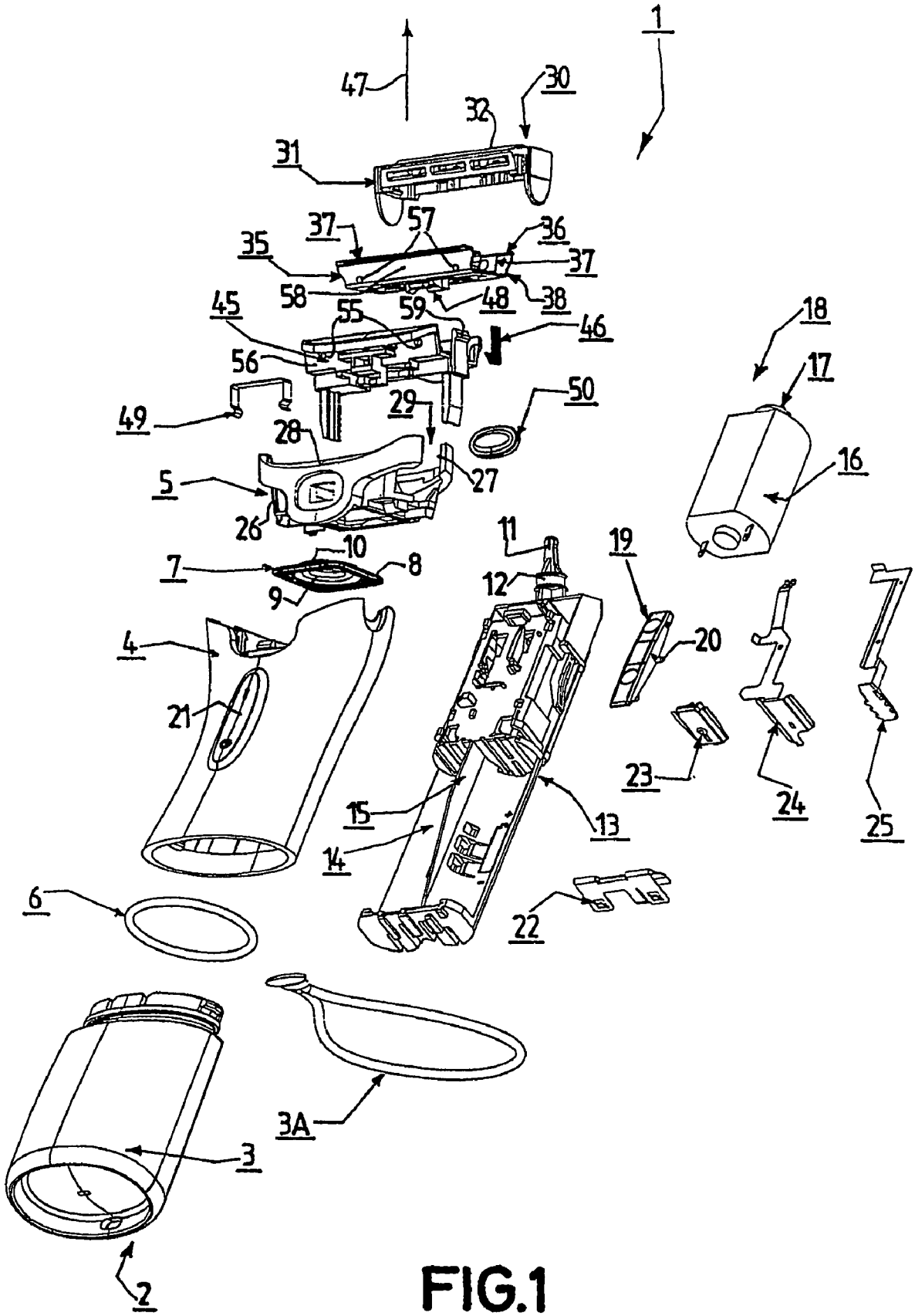
FIG. 1 shows an exploded view and an oblique front view of a shaving apparatus according to one embodiment of the invention.

The shaving apparatus 1 has a housing 2, said housing 2 comprising a total of three main components, namely an essentially pot-shaped bottom portion 3 and an essentially sleeve-shaped central portion 4 and an essentially trough-shaped top portion 5. A carrying loop 3A is joined to the bottom portion 3 but can be detached from it. A scaling ring 6 is fitted between the bottom portion 3 and the central portion 4, and provides a water-tight joint between the bottom portion 3 and the central portion 4.

Figure 2:
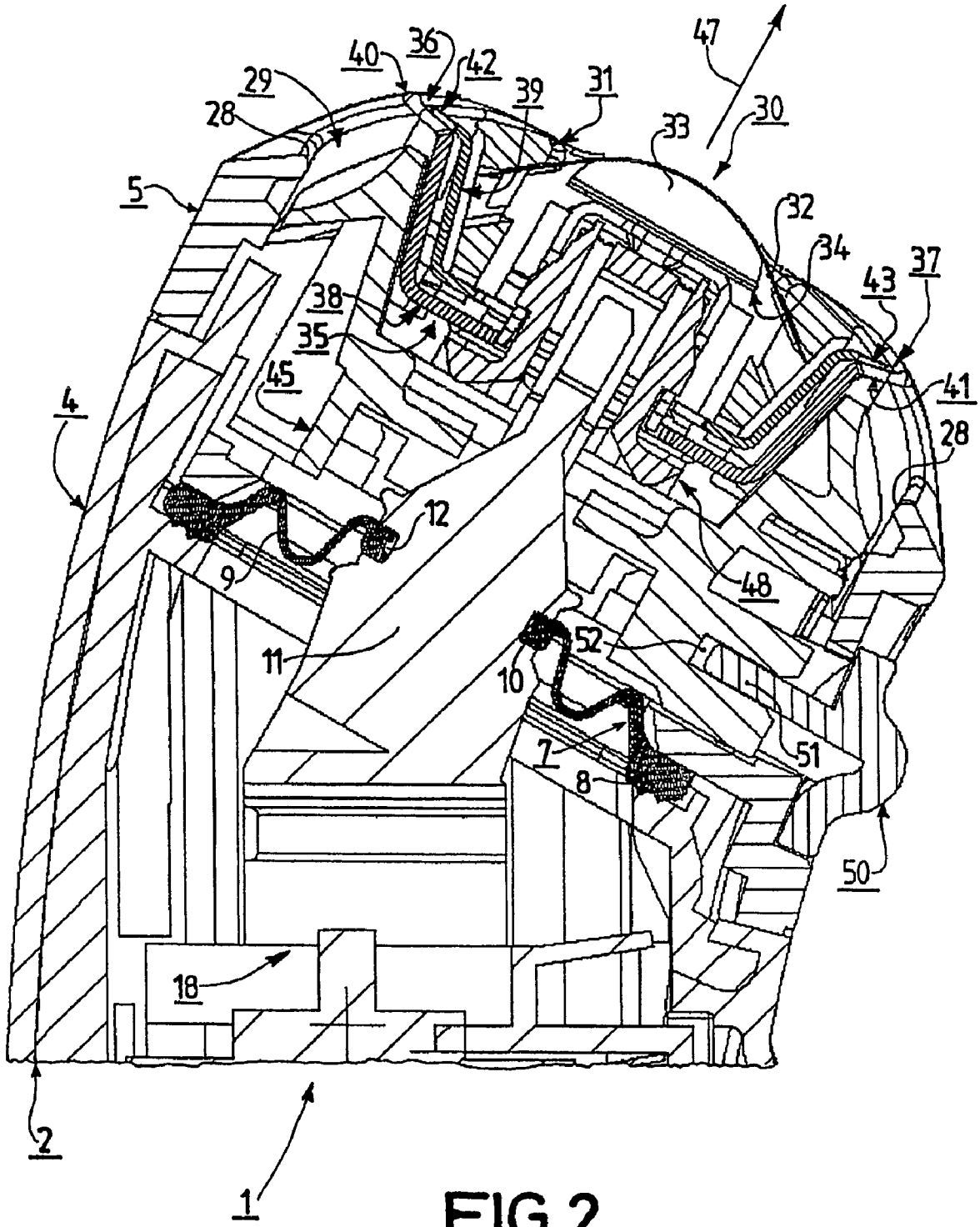
FIG. 2 shows a cross-sectional view of a portion of the shaving apparatus according to FIG. 1, with a short-hair cutting device and a long-hair cutting configuration shown in a first operating position.
Figure 3:
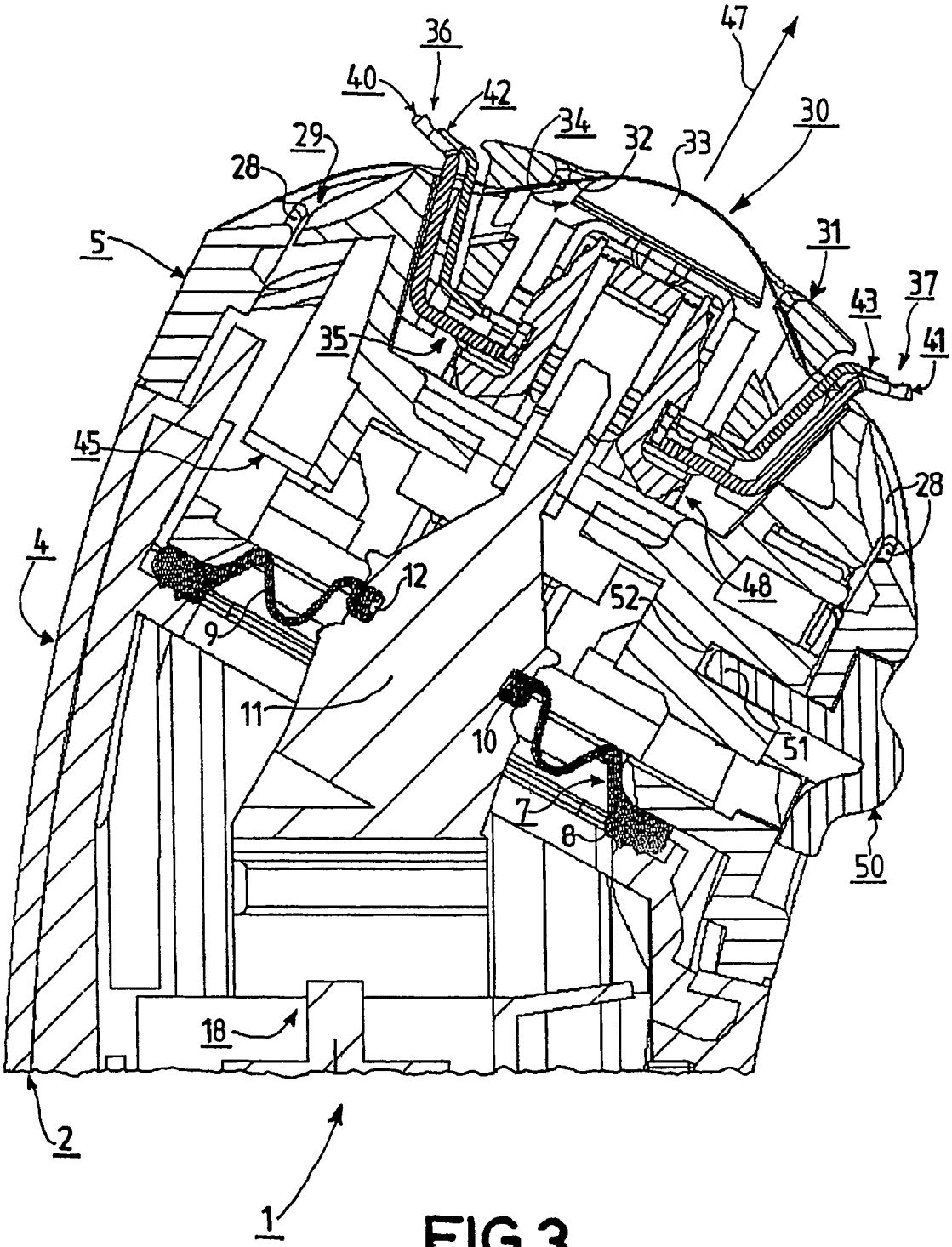
FIG. 3 shows, similarly to FIG. 2, the shaving apparatus according to FIGS. 1 and 2, with the short-hair cutting device and the long-hair cutting configuration shown in a second operating position.

In addition, a bellows joint is provided between the top portion 5 and the central portion 4, which is secured between the top portion 5 and the central portion 4 with an annular fastening component 8, as can be seen from FIGS. 2 and 3. The bellows joint 7 has, in a known manner, a flexible central portion 9 that is corrugated in cross-section and an internal fastening ring 10, the bellows joint 7 being connected by means of the fastening ring 10 to an actuating lever 11 that is drivable with an oscillating motion, i.e. moving to and fro, the fastening ring 10 fitting in an annular groove 12 of the actuating lever 11. The top portion 5 is also often called the shaver-head body or coupling piece.

A chassis 13 is fitted in the section of housing 2 comprising the bottom portion 3 and the central portion 4. Two compartments 14 and 15 are provided, each for one non-rechargeable battery. These batteries are not shown in FIG. 1. In one variant of the shaving apparatus 1 described here, rechargeable batteries are envisaged instead of non-rechargeable batteries. Instead of being equipped with batteries, said shaving apparatus can also be combined with an external charger, which is connected to the shaving apparatus by a lead to provide a d.c. supply to the shaving apparatus.

Chassis 13 also houses a motor 16, and a cam 17 is connected to the spindle of motor 16. The aforementioned actuating lever 11 can be driven to and fro by means of cam 17. Cam 17 and actuating lever 11 form the driving means 18 of the shaving apparatus 1, said driving means 18 being drivable by the motor 16.

A rocker switch 19 is also mounted on chassis 13 and can pivot about a swivel axis 20. Rocker switch 19 is adjustable between two switch positions by means of a cover 21 comprising a soft elastic material. Cover 21 is joined integrally with the central portion 4 of housing 2. The central portion 4 and the cover 21 were manufactured by a so-called two-component injection molding process.

Cover 21 and rocker switch 19 form the switching means for switching the motor 16 of shaving apparatus 1 on and off. By means of rocker switch 19, a circuit can be made and broken between the non-rechargeable batteries (not shown) and motor 16. A total of four contacts are provided for completing the circuit, namely a so-called battery contact 22 and a so-called battery/motor contact 23 and a so-called battery/switch contact 24 and a so-called motor/switch contact 25.

As already mentioned, the top portion 5 of housing 2 is essentially trough-shaped, but without a completely closed trough shape, but a trough shape with the two narrow sides each interrupted by a slot 26 and 27. The trough-shaped top portion 5 is bounded at its end opposite the central portion 4 by a housing edge 28, said housing edge 28 delimiting a passage 29 in housing 2.

Shaving apparatus 1 also has a short-hair cutting device 30 that projects from housing 2 through passage 29. The short-hair cutting device 30 has a holding frame 31, for holding a perforated shaving foil 32. The perforated shaving foil 32 is designed and arranged for interacting with a lamellar cutter 34 comprising a plurality of adjacent cutter blades 33. Said design has been known for a long time. Both the perforated shaving foil 32 and the lamellar cutter 34 each form a short-hair cutting tool. In the present case only the lamellar cutter 34 is drivable by means of motor 16 and the driving means 18. In a variant of the present shaving apparatus 1, however, additional means can also be provided, for additional driving of the perforated shaving foil 32.

Shaving apparatus 1 also has a long-hair cutting configuration 35. The long-hair cutting configuration 35 is essentially U-shaped in cross-section and has a long-hair cutting device 36 and 37 in each case in the region of the free ends of its legs. The long-hair cutting configuration 35 comprises an essentially U-shaped, stationary first long-hair cutting tool 38 and a second long-hair cutting tool 39, also U-shaped, but drivable with to-and-fro motion. The two long-hair cutting tools 38 and 39 each have a row of cutting teeth 40, 41 and 42, 43 in the region of the free ends of their legs, as has also already been known for a long time. In shaving apparatus 1, only the second long-hair cutting tool 39 is drivable by means of motor 16 and the driving means 18 so that it moves to and fro. In a variant of the shaving apparatus 1, additional means are provided so that the first long-hair cutting tool 38 can also be driven with a to-and-fro motion, and then the two long-hair cutting tools 38 and 39 oscillate in opposite directions.

In shaving apparatus 1, the short-hair cutting device 30 is provided between the two long-hair cutting devices 36 and 37 of the long-hair cutting configuration 35. The lamellar cutter 34 is connected to the second long-hair cutting tool 39, so that the second long-hair cutting tool 39 and the lamellar cutter 34 are driven jointly and simultaneously when motor 16 is switched on.

In shaving apparatus 1, advantageously a carrying device 45 is provided. The carrying device 45 serves for carrying both the short-hair cutting device 30 and the long-hair cutting configuration 35, i.e. the two long-air cutting devices 36 and 37. The carrying device 45 is essentially U-shaped like the long-hair cutting configuration 35 and the long-hair cutting configuration 35 and the short-hair cutting device 30 are inserted in the U-shaped carrying device 45 but are detachable and can be removed. For detachable mounting of the long-hair cutting configuration 35, snap-fittings are provided between the long-hair cutting configuration 35 and the carrying device 45, said snap-fittings being produced by means of snap-in holes 55 in the side walls 56 of the carrying device 45 and by means of snap-in lugs 57 on the side walls 58 of the first, stationary, long-hair cutting tool 38. For detachable mounting of the short-hair cutting device 30, two sprung snap-in hooks 59 are provided, only one snap-in hook 59 of said snap-in hooks 59 being visible in FIG. 1. The snap-in hooks 59 are integral with the carrying device 45 and comprise plastics and have snap-in fitting oil the holding frame 31. Two metal leaf springs 46 are provided for force back-up of the two snap-in hooks 59, only one leaf spring 46 of said leaf springs 46 being visible in FIG. 1.

The carrying device 45 can be adjusted parallel to an adjustment direction indicated by an arrow 47 in FIGS. 1 to 3, between a first operating position shown in FIG. 2 and a second operating position shown in FIG. 3. Adjustment of the carrying device 45 is made possible and determined by guiding means for the carrying device 45, said guiding means being provided and being effective between the carrying device 45 and housing 2, in such a way that both the short-hair cutting device 30 and the two long-hair cutting devices 36 and 37 with the carrying device 45 located in its second operating position show in FIG. 3 project farther out of housing 2 than when the carrying device 45 is located in its first operating position shown in FIG. 2.

In shaving apparatus 1, in the region of the free end of the actuating lever 11 and of a drive-counterpart 48 of the long-hair cutting configuration 35 that interacts with the free end of the actuating lever 11, the design is such that with the carrying device 45 located both in its first operating position and in its second operating position, both the drivable short-hair cutting tool i.e. the lamellar cutter 34 of the short-hair cutting device 30 connected to the second long-hair cutting tool 39, and the drivable long-hair cutting tool, i.e. the second long-hair cutting tool 39 of the long-hair cutting configuration 35, can be driven by means of motor 16 and the driving means 18.

A snap-in spring 49 is connected to the carrying device 45 to provide snap-fitting of carrying device 45 in its two operating positions. The snap-in spring 49 engages with the top portion 5 of housing 2.

The shaving apparatus 1 has a sliding button 50 for adjusting the carrying, device 45. Sliding button 50 is accessible from outside of housing 2 and can slide parallel to the adjustment direction 47. Sliding button 50 is coupled to the carrying device 45, namely by means of an extension 51 projecting from the sliding button 50 into the interior of the apparatus, said extension projecting into a recess 52 in the carrying device 45. The sliding button 50 can be pushed easily for example with the thumb by a person using the shaving apparatus 1 parallel to the adjustment direction 47, whereby all the cutting devices 30, 36 and 37 of shaving apparatus 1 can be adjusted to the particular operating position required by the person using the shaving apparatus 1.

In the shaving apparatus 1 described above with reference to FIGS. 1 to 3, the carrying device 45 is only adjustable between two operating positions. In another embodiment of the shaving apparatus 1 according to FIGS. 1 to 3, it is envisaged that the carrying device 45 and hence the cutting devices 30, 36 and 37 are adjustable between three operating positions. Four operating positions are also possible. It is also possible to provide just one long-hair cutting device. It is also possible to provide two or three short-hair cutting devices.

The invention claimed is:

1. A shaving apparatus with a housing, said housing having a passage that is bounded by a housing edge and said housing containing a motor and a driving means drivable by the motor, and with at least one short-hair cutting device projecting out of the housing through the passage and comprising a short-hair cutting tool drivable by the motor and the driving means, and with a long-hair cutting device projecting out of the housing through the passage and comprising a first long-hair cutting tool which is not drivable by the motor and the driving means and a second long-hair cutting tool drivable by the motor and the driving means and located between the first long-hair cutting tool and the short-hair cutting tool, and with a carrying device which is included in the housing and carries both the short-hair cutting device and the long-hair cutting device and is provided for combined adjustment of the short-hair cutting device and the long-hair cutting device and being movable parallel to an adjustment direction between a first operating position and a second operating position such that both the short-hair cutting device and the long-hair cutting device, with the carrying device located in its second operating position, project farther out of housing than when the carrying device is located in its first operating position, wherein both with the carrying device located in its first operating position and with the carrying device located in its second operating position, both the drivable short-hair cutting tool of the short-hair cutting and the drivable second long-hair cutting tool of the long-hair cutting device are drivable by the motor and the driving means, wherein moving the carrying device between the first operating position and the second operating position alters cutting characteristics of the long-hair cutting device while cutting characteristics of the at least one short-hair cutting device remain substantially unchanged.

2. The shaving apparatus according to claim 1, wherein a long-hair cutting configuration is provided, which is essentially U-shaped in cross-section and has a long-hair cutting device in each of the areas, of the free ends of its legs, wherein a short-hair cutting device is provided between the two long-hair cutting devices of the long-hair cutting configuration, and wherein the carrying device is also essentially U-shaped and the long-hair cutting configuration and the short-hair cutting device are inserted into the U-shaped carrying device.

3. The shaving apparatus according to claim 1, further comprising a sliding button for adjusting the carrying device, which sliding button is accessible from outside the housing, can slide parallel to the adjustment direction, and is coupled to the carrying device.

4. The shaving apparatus of claim 1, further comprising a sliding button for adjusting the carrying device such that the at least one short-hair cutting device and the long-hair cutting device, including the first long-hair cutting tool and the second long-hair cutting tool, can be moved together between the first operating position and the second operating position while maintaining relative positions between the at least one short-hair cutting device and the long-hair cutting device.

5. The shaving apparatus of claim 4, wherein the sliding button has an extension projecting into an interior of the shaving apparatus, said extension projecting into a recess in the carrying device.

6. The shaving apparatus of claim 1, wherein the cutting characteristics of the long-hair cutting device are altered by altering a distance of the long-hair cutting device from the housing.

* * * * *